US006358910B1

(12) United States Patent
Boskamp et al.

(10) Patent No.: US 6,358,910 B1
(45) **Date of Patent: *Mar. 19, 2002**

(54) DETERGENT COMPOSITIONS

(75) Inventors: Jelles Vincent Boskamp; Cornelis Bernard Donker; Edwin Leo Lempers, all of Vlaardingen (NL)

(73) Assignee: Lever Brothers Company, divison of Conopco, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/093,634

(22) Filed: Jun. 4, 1998

(30) Foreign Application Priority Data

Jun. 6, 1997 (GB) ..... 9711829

(51) Int. Cl.[7] ..... C11D 1/00; C11D 3/12; C11D 3/20; C11D 3/37; C11D 17/00

(52) U.S. Cl. ..... 510/446; 510/305; 510/309; 510/312; 510/320; 510/374; 510/440; 510/447; 510/470; 510/471; 510/473

(58) Field of Search ..... 510/305, 309, 510/312, 320, 374, 440, 446, 447, 470, 471, 473

(56) References Cited

U.S. PATENT DOCUMENTS

| | | | | |
|---|---|---|---|---|
| 2,560,097 A | | 7/1951 | Emerson et al. | 252/89 |
| 3,953,350 A | | 4/1976 | Fujino et al. | 510/298 |
| 3,962,107 A | | 6/1976 | Levin et al. | 510/117 |
| 4,099,912 A | | 7/1978 | Ehrlick | 8/137 |
| 4,536,377 A | | 8/1985 | Shimp | 423/315 |
| 4,664,839 A | | 5/1987 | Rieck | 252/175 |
| 4,746,456 A | | 5/1988 | Kud et al. | 510/309 |
| 4,751,015 A | | 6/1988 | Humphreys et al. | 510/376 |
| 4,818,426 A | | 4/1989 | Humphreys et al. | 510/375 |
| 4,828,745 A | | 5/1989 | Jeschke et al. | 252/99 |
| 4,828,749 A | | 5/1989 | Kruse et al. | 252/135 |
| 5,133,892 A | | 7/1992 | Chun et al. | 252/90 |
| 5,360,567 A | * | 11/1994 | Fry et al. | 510/298 |
| 5,783,540 A | | 7/1998 | Secemski et al. | 510/224 |
| 5,837,663 A | | 11/1998 | Nicholson et al. | 510/226 |
| 5,900,399 A | | 5/1999 | Seiter et al. | 510/446 |
| 6,051,545 A | * | 4/2000 | Boskamp | 510/446 |

FOREIGN PATENT DOCUMENTS

| | | |
|---|---|---|
| CA | 2226143 | 1/1997 |
| CA | 2298948 | 5/2000 |
| DE | 3417649 | 11/1985 |
| DE | 3742043 | 6/1989 |
| EP | 0 839 906 | 5/1981 |
| EP | 151 203 | 8/1985 |
| EP | 266863 A | 5/1988 |
| EP | 340013 A | 11/1989 |
| EP | 352135 A | 1/1990 |
| EP | 367339 A | 5/1990 |
| EP | 522766 | 5/1990 |
| EP | 384070 | 8/1990 |
| EP | 390251 A | 10/1990 |
| EP | 425277 A | 5/1991 |
| EP | 458397 | 11/1991 |
| EP | 458398 | 11/1991 |
| EP | 0 466 485 | 1/1992 |
| EP | 481793 | 4/1992 |
| EP | 466484 | 11/1992 |
| EP | 549272 | 6/1993 |
| EP | 711827 | 5/1996 |
| EP | 711828 | 5/1996 |
| EP | 716144 | 6/1996 |
| EP | 0 838 519 | 4/1998 |
| EP | 851 025 | 7/1998 |
| GB | 911204 | 11/1962 |
| GB | 1423536 | 2/1976 |
| GB | 1429143 | 3/1976 |
| WO | 95/21908 | 8/1995 |
| WO | 96/23053 | 8/1996 |
| WO | 96/28530 | 9/1996 |
| WO | 97/03177 | 1/1997 |
| WO | 98/03064 | 1/1998 |
| WO | 98/40462 | 9/1998 |
| WO | 98/42816 | 10/1998 |
| WO | 98/42817 | 10/1998 |
| WO | 98/40464 | 12/1998 |
| WO | 98/55582 | 12/1998 |
| WO | 98/55590 | 12/1998 |
| WO | 99/20730 | 4/1999 |
| WO | 99/35230 | 7/1999 |

OTHER PUBLICATIONS

PCT application in a PCT International Search Report, PCT/EP 99/09183, Mar. 1999.

PCT application in a PCT International Search Report, PCT/EP 99/09175, Mar. 1999.

PCT International Search Report in a PCT application PCT/EP 00/05312. Mar. 2000.

Encyclopedia of Chemical Technology, vol. 4, pp. 945–46 and vol. 5, pp. 545–548, Dec. 16,1999.

PCT; International Search Report; PCT/EP 98/03491; Dated Nov. 9, 1998.

* cited by examiner

*Primary Examiner*—Gregory Delcotto
(74) *Attorney, Agent, or Firm*—Rimma Mitelman

(57) ABSTRACT

A tablet of compacted particulate detergent composition including surfactant and detergency builder, suitable for fabric washing, is sub-divided into a plurality of discrete regions with differing compositions. At least one region of the tablet contains a water-swellable polymer serving to promote disintegration of this region. The polymer is present in this region in a concentration greater than in at least one other region of the tablet so as to cause disintegration of the region at a greater speed than disintegration of another region of the tablet.

16 Claims, No Drawings

DETERGENT COMPOSITIONS

FIELD OF INVENTION

This invention relates to cleaning compositions in the form of tablets, eg. for use in fabric washing or machine dishwashing.

BACKGROUND OF THE INVENTION AND SUMMARY OF PRIOR ART

Detergent compositions in tablet form are described, for example, in U.S. Pat. No. 3,953,350 (Kao) and EP-A-711827 (Unilever), and are sold commercially in Spain. Tablets for machine dishwashing are described in W096/28530 (P&G). Tablets have advantages over powdered products in that they do not require measuring and are thus easier to handle and dispense into the washload.

Tablets of a cleaning composition are generally made by compressing or compacting a quantity of the composition in particulate form. It is desirable that tablets have adequate strength when dry, yet disperse and dissolve quickly when added to wash water. In such tablets, any surfactant functions as a binder, plasticising the tablet. However, it can also retard disintegration of the tablet by forming a viscous gel when the tablet comes into contact with water.

There have been a number of proposals for tablets which are subdivided into separate regions (eg. layers) which differ in their composition. This has been done in order to isolate components of the tablet composition during storage of the tablet.

GB-A-911204 discloses tablets in which a detergent tablet contains peroxygen bleach and a bleach activator is confined to a separate layer of the tablet or insert within it.

GB-A-1423536 discloses tablets in which bleach activator is contained in separate, polymer-coated granules while the main part of the tablets includes a soluble or swellable starch.

EP-A-481793 discloses tablets in which sodium percarbonate is isolated in a discrete region of the tablet and enhance stability.

U.S. Pat. No. 3,962,107 discloses a denture cleaning tablet in which enzyme is contained in one layer of the tablet while peroxygen bleach is contained in another, slower-dissolving layer. Both layers contain effervescence producing materials.

U.S. Pat. No. 4,099,912 teaches that fabric washing should be performed using a plurality of tablets containing a plurality of different detergent composition components.

SUMMARY OF THE INVENTION

The present invention makes use of a water-swellable polymeric material to accelerate the disintegration of at least one region of a tablet, ahead of another region or regions.

According to the present invention there is provided a tablet of compacted particulate cleaning composition containing surfactant and detergency builder, and which has a plurality of discrete regions with differing compositions, characterised in that at least one said region of the tablet contains water-swellable polymer, preferably insoluble polysaccharide, in a concentration which is from 0.1 to 8 wt. % and which is greater than in at least one other region of the tablet, to promote disintegration of the first said region(s) before the said other(s).

DETAILED DESCRIPTION

As mentioned above, this invention relates to a tablet which is subdivided into a plurality of discrete regions. The regions of the tablet are most likely to be separate layers within a tablet. However, a discrete region of a tablet could be a core or an insert while another discrete region could be a shell or coating around such core or insert.

The first said region(s) of the tablets which disintegrate and dissolve ahead of other regions can contain an ingredient (eg. enzyme) which is intended to function in the wash liquor before another constituent, contained in the other region(s) of the tablets, is fully released into the wash liquor.

Another possibility is that the other region(s) of the tablet which disintegrate more slowly contain an ingredient which is intended to function towards the end of the wash cycle. For example this could be an antiredeposition polymer or soil suspending polymer. If this is released later in the wash cycle, the proportion of it which is taken up in surfactant micelles and effectively wasted will be minimised.

A further possibility is that a tablet has two layers dissolving at different rates which contain materials to give different values of pH in the wash liquor at different times during a wash cycle.

A tablet of this invention may be intended for use in machine dishwashing. Such a tablet is likely to contain surfactant in a low concentration such as 0.5 to 2 wt % based on the whole tablet, although higher-conecentraions ranging up to 10 wt % may be used. Such will typically contain salts, such as over 60 wt %, often over 85 wt % of the tablet.

Water soluble salts typically used in machine dishwashing compositions are phosphates (including condensed phosphates) carbonates and silicates, generally as alkali metal salts. Water soluble alkali metal salts selected from phosphates, carbonates and silicates may provide 60 wt % or more of a dishwashing composition.

In such a machine dishwashing tablet, a discrete region which disintegrates and dissolves first may be a pre-wash composition containing enzyme(s) and some water soluble salts.

Another possibility is that a tablet of this invention will be intended for fabric washing. In this event the tablet will be likely to contain at least 2 wt %, probably at least 5 wt %, up to 40 or 50 wt % surfactant based on the whole. tablet, and from 5 to 8 wt % detergency builder, based on the whole tablet.

In such a tablet a discrete region which disintegrates and dissolves first may be a pre-wash composition containing enzyme(s). Such a pre-wash composition will generally include detergency builder as 5 to 90% by weight of the discrete region.

The remainder of the composition may then be suitable for the main fabric wash, containing from 5, preferably 10 wt % up to 40% or 50% surfactant.

It will be appreciated that within this invention it is possible that the first said region, containing water-swellable polymeric material, does not itself contain surfactant or detergency builder. It could for example contain enzyme(s) and water-soluble carrier salts which have no function as water-softeners.

However, the first said region(s) which contains water-swellable polymer will often contain detergency builder salts and may contain at least some surfactant.

For instance, for fabric washing, a pre-wash composition, used to form a discrete region of a tablet, might contain enzyme(s), 5 to 90 wt % detergency builder and from 0 to 2% surfactant, together with at least 5 wt % of particles of water-swellable polymer.

In a second aspect, this invention provides a tablet of compacted particulate detergent composition containing surfactant and detergency builder, which has a plurality of discrete regions with differing compositions, characterised in that at least one region of the tablet has a composition which causes it to disintegrate ahead of at least one other region of the tablet, wherein the first said region contains enzyme in a quantity greater than in the other said region, and the other said region contains surfactant and/or bleach in a greater quantity than in the first said region.

The disintegration of the first said region is preferably promoted by incorporation of a water-swellable polymer. However, it could be promoted by incorporation of water soluble materials, more specifically by particles containing at least 40% (by weight of these particles (ii)) of one or more materials selected from compounds with a water-solubility exceeding 50 grams per 100 grams water phase I sodium tripolyphosphate or sodium tripolyphosphate which is partially hydrated so as to contain water of hydration in an amount which is at least 0.5% by weight of the sodium tripolyphosphate in the particles.

There may be a substantial difference in the times for disintegration of the first said region(s) and the other said region(s). An addition of a tablet to water at 20° C. the said other region(s) may remain intact for at least 5 or even at least 10 minutes after disintegration of the first said region (s).

Materials which may be used in tablets of this invention will now be discussed in more detail.

The Water-swellable Polymer

Suitable water-swellable polymeric materials are usually water-insoluble. Preferably they have sufficient water-absorptivity that they can absorb at least four times their own weight of water, ie. a water uptake of at least 4 gm per gm.

A number of such materials are known, and are generally based on cellulose which may be chemically modified to enhance its water uptake capacity. Sometimes such modified celluloses have ionic substituents but for this invention it is preferred that any substituents are nonionic.

Surprisingly, we have found that such a material is more effective if it has a relatively large particle size. We therefore prefer that the polymeric material has a particle dimension of at least 400 better at least 500 micrometres. Such polymeric material with a particle dimension of at least 400 micrometres is preferably an agglomerate of smaller particles whose largest dimension is no greater than 200 micrometres, perferably no greater than 150 micrometres. This makes it possible for at least some of the polymer particles to break up during a wash cycle.

The material may exist as relatively rounded particles, or as relatively flat particles such as flakes or discs. In the latter case a dimension (diameter) of the flakes will be larger, perhaps substantially larger, than the diameter of a sphere with the same volume.

The largest dimension of particles of the polymeric material may be determined by sieve analysis, and the shape of the particles can be observed under a microscope.

It is customary to use sodium carboxymethylcellulose (SCMC) in detergent compositions, usually as not more than 3 wt % of the composition. We have found that such quantities of SCMC are generally ineffective to promote disintegration.

We have found it desirable to use swellable polymeric materials with little or no ionic character. Such materials may be polysaccharides with little or no ionic substitution.

The absence or near absence of ionic substitution can be expressed by stating that the charge density of the polymeric material is low, such as less than $10^{-3}$, better less than $6\times10^{-4}$ or even zero. The term "charge density" denotes the number of charges on a polymer molecule divided by the molecular weight of the polymer. It is essentially the same as the average number of charges on a repeat unit of the polymer divided by the average molecular weight of a repeat unit.

The water-insoluble, water-swellable material is preferably added as particles which contain such material as at least 75% of the anhydrous weight of these particles (i.e ignoring their moisture content) and usually they will contain little or nothing except the polymer and any accompanying moisture.

These particles preferably do not provide more than 5 or 8 wt % of the tablet as a whole. However, a discrete region of a tablet may contain a higher concentration of such particles, eg. from 3 wt % up to 10 or 15 wt % of the region.

Further Disintegration-promoting Particles

The water-swellable polymer may be accompanied in the first said region(s) of the tablet by further particles which contain at least 40% of their own weight, better at least 50%, of a material which has a solubility in deionised water at 20° C. of at least 50 grams per 100 grams of water.

The said particles may provide material of this specified solubility in an amount which is from 5 to 40 wt %, preferably 5 to 25 wt %, of the first said region(s) of the tablet.

A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid to form a saturated solution in 100 grams of water at 20° C.

| Material | Water Solubility (g/100 g) |
|---|---|
| Sodium citrate dihydrate | 72 |
| Potassium carbonate | 112 |
| Urea | >100 |
| Sodium acetate | 119 |
| Sodium acetate trihydrate | 76 |
| Magnesium sulphate $7H_2O$ | 71 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 40% by weight of these particles.

It may be preferred that the highly water-soluble material is a salt which dissolves in water in an ionised form. As such a salt dissolves it leads to a transient local increase in ionic strength which can assist disintegration of the tablet by preventing nonionic surfactant from swelling and inhibiting dissolution of other materials.

Another possibility is that the water-swellable polymer is accompanied by further particles to promote disintegration which contain sodium tripolyphosphate with at least 40% (by weight of the further particles) of the anhydrous phase I form.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 50% or 55% by weight of the tripolyphosphate in the particles.

Suitable material is commercially available. Suppliers include Rhone-Poulenc, France and Albright & Wilson, UK.

Another possibility is that further particles which promote disintegration contain at least 40% (of their own weight) of sodium tripolyphosphate which is partially hydrated. The extent of hydration may lie in a range from 0.5 to 4% by weight of the sodium tripolyphosphate in the particles, or it may be higher. Indeed fully hydrated sodium tripolyphosphate may be used to provide these particles.

It is possible that the particles contain at least 40 wt % sodium tripolyphosphate which has a high phase I content but is also sufficiently hydrated so as to contain at least 0.5% water by weight of the sodium tripolyphosphate.

Particles as above may provide sodium tripolyphosphate in a quantity which is at least 8%, e.g. 8 to 30%, by weight of the composition of the first said region(s) of the tablet.

The remainder of the tablet composition used to form the first said region(s) of the tablet may include additional sodium tripolyphosphate. This may be in any form, including sodium tripolyphosphate with a high content of the anhydrous phase II form.

It is within the scope of the second aspect of this invention that the first said region includes particles containing a highly water soluble compound or particles containing phase I tripolyphosphate or hydrated tripolyphosphate, all as discussed above, without any water-swellable polymer.

Surfactant Compounds

Compositions which are compacted to form some tablet regions will contain one or more detergent surfactants. In a fabric washing composition, these preferably provide from 5 to 50% by weight of the overall tablet composition, more preferably from 8 or 9% by weight of the overall composition up to 40% or 50% by weight. Surfactant may be anionic (soap or non-soap), cationic, zwitterionic, amphoteric, nonionic or a combination of these.

Anionic surfactant may be present in an amount from 0.5 to 50% by weight, preferably from 2% or 4% up to 30% or 40% by weight of the tablet composition.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic surfactant. Linear alkyl benzene sulphonate of the formula

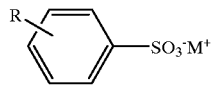

where R is linear alkyl of 8 to 15 carbon atoms and $M^+$ is a solubilising cation, especially sodium, is also a commercially significant anionic surfactant.

Frequently, such linear alkyl benzene sulphonate or primary alkyl sulphate of the formula above, or a mixture thereof will be the desired anionic surfactant and may provide 75 to 100 wt % of any anionic non-soap surfactant in the composition.

In some forms of this invention the amount of non-soap anionic surfactant lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic surfactant compounds which may be used include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to moles of ethylene oxide per mole of alcohol.

In some fabric washing tablets of this invention, the amount of nonionic surfactant lies in a range from 4 to 40%, better 4 or 5 to 30% by weight of the whole tablet. Many nonionic surfactants are liquids. These may be absorbed onto particles of the composition.

In a machine dishwashing tablet the surfactant may be wholly nonionic, in an amount below 5 wt % of the whole tablet although it is known to include some anionic surfactant and to use up to 10 wt % surfactant in total.

Detergency Builder

A composition which is compacted to form some regions of tablets will contain from 5 to 80%, more usually 15 to 60% by weight of detergency builder. This may be provided wholly by water soluble materials, or may be provided in large part or even entirely by water-insoluble material with water-softening properties. Water-insoluble detergency builder may be present as 5 to 80 wt %, or from 10 to 80 wt % better 5 to 60 wt % of the composition.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8–1.5Na_2O.Al_2O_3.0.8–6SiO_2.xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the novel zeolite P described and claimed in EP 384070 (Unilever) and mixtures thereof.

Conceivably a water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

Water-soluble phosphorous-containing inorganic detergency builders, include the alkali-metal orthophosphates, metaphosphates, pyrophosphates and polyphosphates.

Specific examples of inorganic phosphate builders include sodium and potassium tripolyphosphates, orthophosphates and hexametaphosphates.

Non-phosphorous water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

At least one region of a fabric washing tablet preferably include polycarboxylate polymers, more especially polyacrylates and acrylic/maleic copolymers which can function as builders and also inhibit unwanted deposition onto fabric from the wash liquor.

Bleach System

Tablets according to the invention may contain a bleach system in at least one region of a tablet. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, absorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets.

A tablet for fabric washing will generally not contain more than 15 wt % silicate. A tablet for machine dishwashing will often contain more than 20 wt % silicate.

Further ingredients which can optionally be employed in a region of a fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

Each discrete region of a detergent tablet of this invention, is a matrix of compacted particles.

Preferably the particulate composition has an average particle size in the range from 200 to 2000 μm, more preferably from 250 to 1400 μm. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/litre, preferably at least 500 g/litre, and perhaps at least 600 g/litre.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), may be used to product at least some tablet regions.

When a tablet incorporates particles of a water-swellable polymeric material, or other particles to promote disintegration, they are preferably mixed with the remainder of the particulate composition, prior to compaction into tablets.

Manufacture of a tablet with two layers of differing composition may be carried out by placing a predetermined quantity of one composition in a mould, then adding a second composition on top, and next driving a die into the mould to cause compaction.

Alternatively, a predetermined quantity of a composition may be placed in a mould and compacted by driving a die into the mould, followed by removing the die, adding a second composition and compacting again.

Tablets with even more layers can be made by these routes, but with extra stages of loading particulate material into the die, and possibly compacting after each stage.

Tableting machinery able to carry out such operations is known, for example suitable tablet presses are available from Fette and from Korch.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/litre up to 1300 gm/litre. The tablet density may well lie in a range up to no more than 1250 or even 1200 gm/litre.

EXAMPLES

Example 1

Demonstrating the Effect of Water-swellable Polymer

Experiments were carried out with a polymeric material derived from cellulose and marketed by Rettenmaier GmbH as "Arbocel A1". As supplied it has particles with a range of shapes and particle sizes (as determined by sieve analysis) with an average diameter of 1 mm. It was found to have a water-uptake of 5.7 gm/gm.

The material was mixed, at a concentration of 5% by weight with each of four detergent powders. These powders were then stamped into detergent tablets. Control tablets were made from the same powders without Arbocel A1. The main constituents of these powders are given in the table below.

Some tablets made from each of the four powders were fully immersed in water at 20° C. The tablets containing Arbocel were observed to break up in times less than one minute. During the same period of time the control tablets remain intact.

For some of the tablets the break-up, dispersion and dissolution of tablets was measured by a test procedure in which a tablet is placed on a plastic sieve with 2 mm mesh size which was immersed in 9 litres of demineralised water at ambient temperature of 20° C. The water conductivity was monitored until it reached a constant value. The time for dissolution of the tablets was taken as the time ($T_{90}$) for change in the water conductivity to reach 90% of its final magnitude. The results are included in the table below.

| | | | Visible disintegration | | $T_{90}$ conductivity measurement | |
|---|---|---|---|---|---|---|
| | Composition of Powder | Powder bulk density | without Arbocel A1 | with Arbocel A1 | without Arbocel A1 | with Arbocel A1 |
| A | 16 wt % total surfactant, 46% sodium tripolyphosphate | 640 gm/litre | >10 minutes | <1 minute | 4 minutes | 2 minutes |
| B | 16 wt % total surfactant, 31% zeolite, zero phosphate | 880 gm/litre | >10 minutes | <1 minute | over 10 minutes | 2 minutes |
| C | 19 wt % total surfactant, 15% zeolite, 10% layered silicate, zero phosphate | | >10 minutes | <1 minute | over 10 minutes | 4 minutes |
| D | spray dried: 9% total surfactant, 35% sodium tripolyphosphate | about 550 gm/litre | >10 minutes | <1 minute | | |

In comparative experiments, tablets were made using 5% of Arbocel A1 which had been gently ground with a pestle and mortar to reduce the size of the particles, (to the primary particle size of approximately 120 micrometres). This ground material was much less effective at promoting tablet disintegration.

Example 2

Demonstrating Particles to Provide Disintegration

Tablets for use in fabric washing were made, starting with a spray-dried base powder of the following composition:

| Ingredient | Parts by Weight |
|---|---|
| Sodium linear alkylbenzene sulphonate | 11.0 |
| Sodium tripolyphosphate (Added to the slurry as anhydrous sodium tripolyphosphate containing at least 70% phase II form.) | 16.8 |
| $C_{13-15}$ fatty alcohol 7EO | 2.4 |
| $C_{13-15}$ fatty alcohol 3EO | 2.3 |
| Sodium silicate | 4.0 |
| Soap | 0.21 |
| Acrylate/maleate copolymer | 1.5 |
| Sodium sulphate, moisture and minor ingredients | balance to 45 parts |

A number of particulate compositions were made by mixing this powder with other ingredients as tabulated below these included particles of sodium tripolyphosphate specified to contain 70% phase I form and contain 3.5% water of hydration (Rhodia-Phos HPA 3.5 available from Rhone-Poulenc).

The added ingredients also included particles of water-insoluble water-swellable polymeric material. This material was "Arbocel A1" as in Example 1. For some compositions this material was sieved to provide a fraction with a narrower range of particle size.

The compositions were balanced to 100% by including varying amounts of dense anhydrous sodium carbonate. The various compositions contained the following percentages by weight:

| Ingredient | % by weight |
|---|---|
| Base powder | 45.0 |
| Sodium percarbonate granules | 15.0 |
| TAED granules | 3.4 |
| Anti-foam granules | 3.2 |
| Perfume, enzymes and other minor ingredients | 3.5 |
| HPA tripolyphosphate | variable, 15 to 30% |
| Water-swellable polymer | variable, 0 to 5% |
| Sodium carbonate | balance, 0 to 12% |

40 g portions of each composition were made into cylindrical tablets of 44 mm diameter, using a Fette pilot plant press, with a fixed level of applied pressure so as to produce tablets of density in a range from 1100 to 1250 kg/m$^3$.

The strength of these tablets was measured using an Instron universal testing machine to compress a tablet until fracture. The value of diametral fracture stress (DFS) was then calculated using the equation $$\sigma = \frac{2P}{\pi D t}$$

where σ is the diametral fracture stress in Pascals, P is the applied load in Newtons to cause fracture, D is the tablet diameter in metres and t is the tablet thickness in metres.

The break-up, dispersion and dissolution of tablets was measured by a test procedure as in Example 1.

The percentages of HPA tripolyphosphate, and polymeric material, together with the DFS values and conductivity results are set out in the following table:

| code # | HPA tripoly-phosphate | polymeric material | balancing carbonate | DFS (kPa) | $T_{90}$ (minute) |
|---|---|---|---|---|---|
| A | 30% | 0 | 0 | 43 | 3.0 |
| B | 24% | 2% as supplied | 4% | 32 | 3.2 |
| C | 15% | 5% as supplied | 10% | 18 | <1 |
| D | 15% | 0 | 15% | 45 | >9.0 |
| E | 15% | 5% 470–800μ | 10.0 | 30 | 3.2 |
| F | 15% | 5% 800–1400μ | 10.0 | 21 | 1.4 |
| G | 15% | 3% 800–1400μ | 12.0 | 33 | 2.8 |

Example 3

An enzyme-containing composition was prepared from the base powder used in Example 2, and added ingredients as follows:

| Ingredient | % by weight |
|---|---|
| Base powder | 45.0 |
| Protease (Savinase ex Novo) | 4.0 |
| Lipase (Lipolase ex Novo) | 0.8 |
| Amylase (Termamyl ex Novo) | 2.5 |
| Anti-foam granules | 3.2 |
| Minor ingredients | 2.0 |
| HPA tripolyphosphate | 22.5 |
| Water-swellable polymer | 5 |
| Sodium carbonate | 15 |
| TOTAL | 100 |

15 gm of this composition was used to provide one layer of a two layer tablet. The other layer of the tablet was provided by 35 gm of a bleach containing composition as follows:

| Ingredient | % by weight |
|---|---|
| Base powder | 45.0 |
| Sodium percarbonate granules | 20.0 |
| TAED granules | 5.0 |
| Anti-foam granules | 3.0 |
| Minor ingredients | 2.0 |
| HPA tripolyphosphate | 15 |
| Sodium carbonate | 10 |
| TOTAL | 100 |

On addition to water the first layer disintegrated and its soluble constituents dissolved in under one minute. The second layer remained intact for about 9 minutes.

Example 4

Two granulated base powders have the following compositions:

| Ingredient | parts by weight A | B |
|---|---|---|
| Sodium linear alkylbenzene sulphonate | 4.0 | 10 |
| $C_{13-15}$ fatty alcohol 7EO. | 6.7 | 1.7 |
| $C_{13-15}$ fatty alcohol 3EO. | 4.1 | 2.4 |
| Soap | 0 | 1.0 |
| Zeolite A24 | 28.0 | 21.0 |
| Sodium carbonate | 3.7 | 3.7 |
| Sodium citrate dihydrate | 4.6 | 3.1 |
| moisture and minors | 5.4 | 5.1 |
| TOTAL | 56.5 | 48 |

Two particulate compositions were made by mixing these powders with other ingredients as set out in the table below. The water-swellable polymer was "Arbocel A1" used as supplied.

| Ingredient | % by weight C | D |
|---|---|---|
| Base powder A | 56.5 | |
| Base powder B | | 48 |
| Sodium perborate monohydrate | 8 | 14.8 |
| TAED granules | 2.3 | 5.5 |
| Anti-foam granules | 2.0 | 2.0 |
| Fluorescer granules | 0 | 2.0 |
| Sodium silicate granules | 3.7 | 3.7 |
| Acrylate/maleate copolymer | 3.0 | 1.0 |
| Perfume, enzymes and other minor ingredients | 3.5 | 3.5 |
| Sodium acetate trihydrate | 16 | 11.0 |
| Water-swellable polymer | 5 | 2.5 |
| Sodium carbonate | 0 | 6.0 |
| TOTAL | 100 | 100 |

Tablets are made using 20 g of composition C to make one layer and 20 g of composition D to make the other layer. On addition to water the layer of composition A disintegrates within less one minute, releasing builder to substantially soften the water before the disintegration of the second layer after about six minutes, which releases most of the anionic surfactant, including all of the soap.

Example 5

Two particulate compositions are made by mixing base powder B from the previous example with other ingredients as set out in the table below. The water-swellable polymer was "Arbocel A1" used as supplied. The soil suspending polymer was a graft copolymer as described in U.S. Pat. No. 4,746,456.

| Ingredient | % by weight E | F |
|---|---|---|
| Base powder B | 48 | 48 |
| Sodium perborate monohydrate | 13.9 | 13.9 |
| TAED granules | 5.3 | 5.3 |

-continued

| Ingredient | % by weight E | F |
|---|---|---|
| Anti-foam granules | 2.0 | 2.0 |
| Fluorescer granules | 2.0 | 2.0 |
| Sodium silicate granules | 3.7 | 3.7 |
| Acrylate/maleate copolymer | 1.5 | 1.0 |
| Polyvinypyrrolidone | 0 | 1.5 |
| Soil release polymer | 0 | 4.5 |
| Perfume | 0.6 | 0.6 |
| enzymes | 2.0 | 0 |
| Sodium acetate trihydrate | 16 | 11.0 |
| Water-swellable polymer | 5 | 2.0 |
| Sodium carbonate | 0 | 4.5 |
| TOTAL | 100 | 100 |

Tablets are made using 30 g of composition E to make one layer and 15 g of composition F to make the other layer. On addition to water the layer of composition E disintegrates within one minute. The layer of composition F disintegrates after about 7 minutes, thus delaying release of the two polymers.

What is claimed is:

1. A tablet of compacted particulate cleaning composition containing from 5 to 50 wt % surfactant and from 5 to 80 wt % detergency builder, and which a has a plurality of discrete regions with differing compositions, characterised in that a first said region of the tablet contains particles which contain water-swellable water-insoluble polysaccharide as at least 75% of the anhydrous weight of these particles, with a particle dimension of at least 400 micrometres in a concentration which is from 0.1 to 8 wt % of the region and is greater than in at least one other region of the tablet, to promote disintegration of the first said region(s) before said other(s).

2. A tablet according to claim 1 wherein said first region contains enzyme(s) and the said other region(s) contain bleach or bleach activator.

3. A tablet according to claim 1, wherein the polysaccharide material has a particle dimension of at least 500 micrometres.

4. A tablet according to claim 1, wherein the polysaccharide material is substantially nonionic such that the charge density of the polymeric material does not exceed $10^{-3}$.

5. A tablet according to claim 1, wherein said first region also contains further particles comprising at least 40% by weight of the particles of one or more materials selected from the group consisting of compounds with a water-solubility exceeding 50 grams per 100 grams water phase 1 sodium tripolyphosphate and sodium tripolyphosphate which is partially hydrated so as to contain water of hydration in an amount which is at least 0.5% by weight of the sodium tripolyphosphate in the particles.

6. A tablet according to claim 1, wherein said first region of the tablet contains 0.5 to 50 wt % surfactant and, 5 to 80 wt % detergency builder.

7. A tablet according to claim 1, wherein said first region contains enzyme in a quantity greater than in the other said region, and the other said region contains bleach in a greater quantity than in said first region.

8. A tablet according to claim 1, which overall contains 5 to 60 wt % water-insoluble detergency builder.

9. A tablet according to claim 1, which overall contains from 10 to 80% by weight of water-soluble detergency builder.

10. A process of making a tablet as defined in claim 1, comprising placing quantities of at least two particulate compositions in a mould and compacting these therein, characterised by adding water-swellable polysaccharide material to one of the compositions prior to compaction, so as to establish therein a greater concentration of the water-swellable material than in the other composition(s).

11. A tablet according to claim 5, wherein said first region of the tablet contains from 5 to 40 wt % of said further particles to promote disintegration.

12. A tablet according to claim 1 wherein said first region of the tablet and said at least one other region of the tablet are separate layers of the tablet.

13. A tablet according to claim 1 wherein said at least one other region of the tablet contains surfactant in a greater quantity than in the first said region.

14. A tablet according to claim 1 wherein said at least one other region contains soil suspending polymer absent from the first said region.

15. A tablet according to claim 1 wherein the concentration of the water-swellable, water-insoluble polysaccharide is from 30% to 8 wt %.

16. A tablet of compacted particulate cleaning composition containing from 0.5 to 2 wt % surfactant and at least 60 wt % water-soluble salts and which has a plurality of discrete regions with differing compositions, wherein a first said region of tablet contains at least one enzyme and also particles which contain water-swellable water-insoluble polysaccharide as at least 75% of the anhydrous weight of these particles with a particle dimension of at least 400 micrometers in a concentration which is from 0.1 to 8 wt % of the region and which is greater than in at least one other region of the tablet, thereby to promote disintegration of the enzyme-containing first said region(s) before said other(s).

* * * * *